United States Patent [19]

Tarr

[11] Patent Number: 4,609,198

[45] Date of Patent: Sep. 2, 1986

[54] RACKET HANDLE ASSEMBLY HAVING VIBRATION DAMPENING CHARACTERISTICS

[76] Inventor: Robert G. Tarr, 45 Arcturus Road, Highlands, Harare, Southern Rhodesia

[21] Appl. No.: 549,760

[22] Filed: Nov. 8, 1983

[51] Int. Cl.[4] ..... A63B 49/08

[52] U.S. Cl. ..... 273/73 J

[58] Field of Search ..... 273/73 J, 75, 80.4, 273/73 E, 73 D, 73 H, 73 K, 81.2, 73 C, 73 G

[56] References Cited

U.S. PATENT DOCUMENTS

| | | | |
|---|---|---|---|
| Re. 20,684 | 2/1937 | Dickson | 273/73 J |
| 1,563,780 | 12/1925 | Ovenshire | 273/73 J |
| 1,587,918 | 6/1926 | Morrison | 273/73 J |
| 1,937,787 | 12/1933 | Robinson | 273/73 D |
| 2,603,260 | 7/1952 | Floren | 273/73 J UX |
| 3,751,083 | 8/1973 | Jacobson et al. | 273/73 E UX |
| 4,105,205 | 8/1978 | Theodores et al. | 273/73 J |

FOREIGN PATENT DOCUMENTS

| | | | |
|---|---|---|---|
| 4207 | of 1926 | Australia | 273/73 J |
| 20013 | of 1929 | Australia | 273/80.4 |
| 1903722 | 8/1970 | Fed. Rep. of Germany | 273/73 C |
| 2438807 | 3/1975 | Fed. Rep. of Germany | 273/73 E |
| 2843640 | 1/1980 | Fed. Rep. of Germany . | |
| 429666 | 6/1935 | United Kingdom | 273/80.4 |
| 498430 | 1/1939 | United Kingdom | 273/73 J |

*Primary Examiner*—Richard C. Pinkham
*Assistant Examiner*—Matthew L. Schneider
*Attorney, Agent, or Firm*—Cushman, Darby & Cushman

[57] ABSTRACT

A shock adsorbing racket handle assembly for use with a wide variety of rackets. The assembly includes a specially formed racket shaft attached to the head and a grip whose interior is similarly shaped so that an engineered space is defined therebetween. Damping material is used within that engineered space and tensioning device is used to hold the assembly together and to appropriately determine a particular player's choice of shock adsorption and feel or hitting characteristics for the racket.

11 Claims, 12 Drawing Figures

Fig. 6
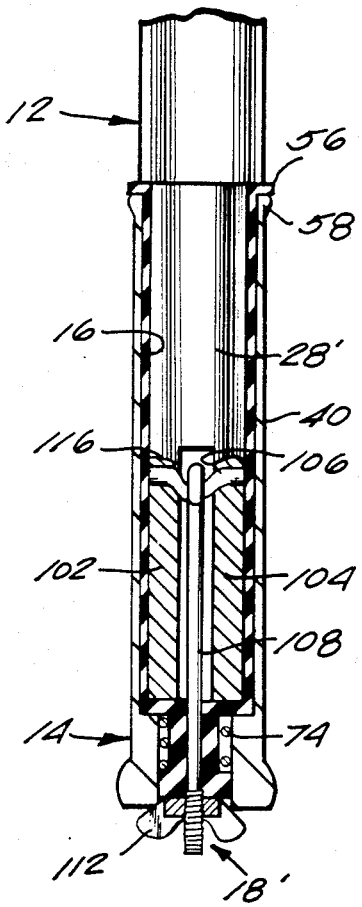
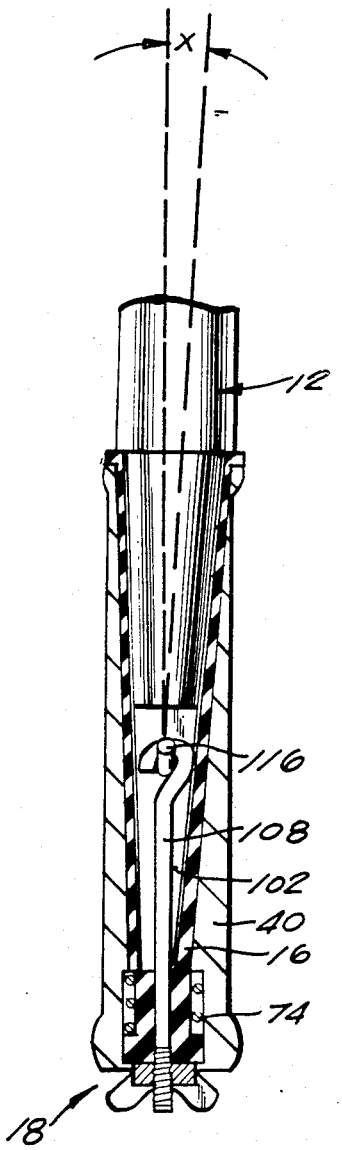
Fig. 7

32
26
12
28
30

12

14
12
92
16
x
10
12
56
60
58
2b
2b
20
16
14

12
4b
4b
10
14

2c
2c
4c
4c
18
18
x
x

RACKET HANDLE ASSEMBLY HAVING VIBRATION DAMPENING CHARACTERISTICS

FIELD OF THE INVENTION

This invention relates to an improved tennis or game racket handle structure useful as a handle for a variety of types of rackets that provides superior damping qualities and provides a compromise between a rigid racket structure and a flexible or whippy racket structure that provides proper control under a wide variety of hitting conditions.

BACKGROUND OF THE PRESENT INVENTION

Modern rackets, used for tennis or for that matter, other sports including hand ball, squash and badminton, can be made from a wide variety of materials including laminated wood, steel tubing, aluminum, fiberglass, boron, graphite, as well as various combinations of these materials.

While experience over the years has shown that wood rackets absorb shock vibrations, it is relatively less strong than many of the other racket materials listed above. Thus, to produce a very rigid hitting platform or racket head in order to produce the greatest amount of power, very stiff rackets built from graphite or steel would be preferable.

On the other hand, if a person has tennis elbow or wishes to minimize elbow damaging vibrations occasioned by the racket head's contact with the ball, especially when very hard ground strokes are contemplated, then a more flexible racket structure would be preferred.

Over the years, the art has addressed various problems in attempting to vary the hitting force of racket strokes or in effect, to control the stiffness of a racket. Exemplary of this type of effort are Morrison, U.S. Pat. No. 1,587,918; Staub, British Pat. No. 498,430; Theodores et al, U.S. Pat. No. 4,105,205 and Dobo et al, German Pat. No. 2,843,640.

Morrison varies the hitting force during the stroke of his racket by incorporating a movable weight within a hollow handle that could be moved either towards or away from the elliptical head portion which he hoped could meet the particular stroke requirements for a particular user. The weight can be moved from a substantially neutral position immediately beneath the hand grip of the user to a position adjacent the head of the racket where the weight would provide an enlarged hitting force. The weight itself is prevented from lateral movement as is the threaded rod on which the rod is mounted.

In Staub, a hollow body is incorporated in the hollow racket handle so that it can be moved axially along the handle. When moved, it will displace a paste formed from inert, non-volatile liquids, such as glycerine which has been mixed together with a powder such as a pulverized metal. A threaded rod connects the hollow body to a disk provided at the base of the handle and by turning that disk the threaded shaft is rotated which positions the hollow body within the handle and thus varies the displacement of the paste. The percussion effect of the racket is changed as the paste material is moved so that as more paste is moved toward the head, the handle becomes relatively lighter and the percussion effect will be greater. When those conditions are reversed, with more paste lower in the handle the percussion effect will be less. In addition, an alternative embodiment suggests the inclusion of weights either at the base of the handle or adjacent the head of the racket which would again produce the same alternatives of having more weight lower in the handle or more toward the head, thereby modifying the percussion effect of the racket.

In Theodores et al, the stiffness of the racket is adjustable by using a shaped beam which has more flexibility in one direction than another. By rotating that beam, relative to the plane of the head of the racket, a more or less stiff effect can be achieved. One or more such beams can be used in the racket with the plurality being controlled by an interconnecting gear mechanism. The possibility is also suggested of incorporating a viscous damping fluid, such as a silcone, within the handle cavity or the clearance between the beam(s) and the interior of the hollow handle. Thus, by changing the various position of the beam within the handle, the stiffness of the racket and vibration damping can be modified.

In Dobo et al, the shaft depending from the head is held in an adjustable handle structure where the stiffness can be controlled by controlling the degree to which the shaft is gripped by an adjustable rubber, buffer device adjacent the top of the handle.

None of these attempts to effect racket structures suggest how to provide a consistent compromise between having a very rigid hitting platform and a more flexible racket structure so that while the shocks transmitted can be reduced, a pleasant and firm feel can be achieved for the player.

SUMMARY OF THE PRESENT INVENTION

The present invention provides a compromise between a racket having maximum power transmission capabilities and one that has a handle that will suitably absorb shock vibrations and thus minimize elbow-damaging vibrations. This is accomplished by forming the main frame of the racket and the grip assembly as separate portions, inserting a damping material therebetween so that relative movement can occur between the frame and handle assembly during hitting strokes and means to adjust the tension therebetween. In order to allow for a variety of styles of hitting the adjustable mechanism is provided between the main frame shaft of the racket and the grip assembly with the amount of tensioning controlling the amount of damping desired. Thus, whether one employs a main frame shaft made of wood, graphite material or something else, a suitable amount of flexibility or stiffness can be incorporated while at the same time incorporating a damping effect within the structure. Thus, the present invention provides both the feel and dynamic response that one would request of a racket while at the same time providing suitable damping to reduce the effects of shock vibrations generated during play. Thus, the present invention provides a handle structure for a racket that will not alter the basic look or feel of the racket nor its dynamic characteristics except during the very brief moment of contact and rebound time when a ball is actually being struck. Additionally, personal preferences with respect to the feel and touch of the racket as well as the comfort level desired is provided by having the securing mechanism adjustable.

Other objects, features, and characteristics of the present invention as well as the methods and operation and functions of the related elements of the structure, and to the combination of parts and economies of manufacutre, will become more apparent upon consideration of the following description and the appended claims with reference to the accompanying drawings, all of which form a part of this specification, wherein like reference numerals designate corresponding parts in the various figures.

Figure 1:
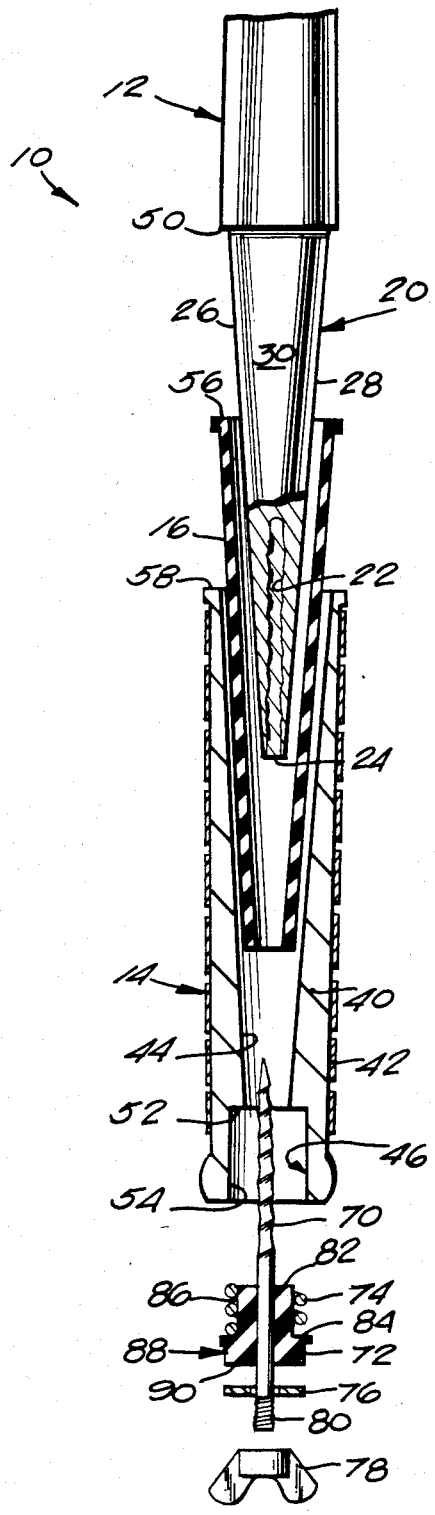
FIG. 1 is an exploded diagrammatic side, elevational view, partly in cross-section for clarity, of the handle of a racket.

FIGS. *2a, 2b* and *2c* show the handle assembly of FIG. 1 in a neutral mode position with FIG. *2b* being a cross-sectional view along the line *2b—2b,* and FIG. *2c* being a cross-sectional view across line *2c—2c;*

FIGS. *3a* and *3b* show two cross-sectional views where the maximum amount of rotation has occurred relative to the shaft and grip assemblies when the ball has been struck off center with FIG. *3a* being viewed at a point comparable to the line *2b—2b* and FIG. *3b* being viewed at a point comparable to line *2c—2c;*

FIGS. *4a, 4b* and *4c* show the assembly as set forth in FIG. 1 where the movement represents maximum impact at the center of the racket head with FIG. *4b* being a cross-sectional view along line *4b—4b,* and FIG. *4c* being a cross-sectional view along line *4c—4c;*

Figure 5:
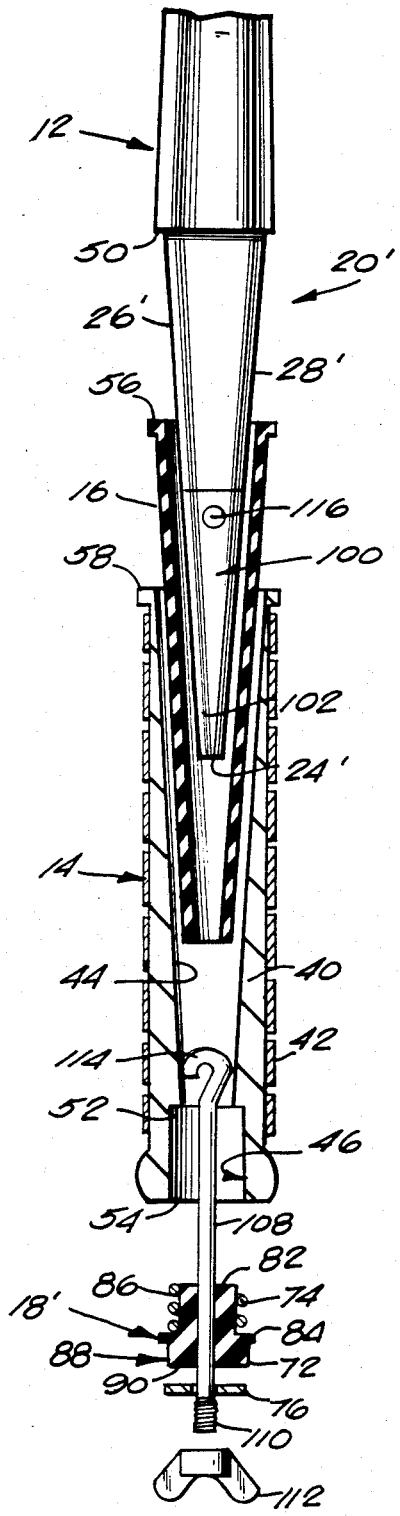

FIG. 5 is an exploded diagrammatic, side elevational view, partly in cross-sectional for clarity, of a modification of the racket handle assembly shown in FIG. 1;

FIG. 6 is a diagrammatic, front, elevational view of the assembly shown in FIG. 5 with the parts being connected together; and FIG. 7 is a diagrammatic, side, elevational view of FIG. 6.

DETAILED DESCRIPTION OF THE PREFERRED EMBODIMENTS OF THE PRESENT INVENTION

Turning now to FIG. 1, which is an exploded view of the racket handle assembly, that assembly is indicated generally at 10 with the main frame of the racket shaft being indicated at 12, a grip assembly 14, a damping pad 16 lying between the main frame shaft 12 and the grip assembly 14 and a tensioning assembly 18. In FIG. *2a,* these elements are shown connected together.

Main frame shaft 12 includes a wedge shaped lower portion 20 as well as a bore 22 which extends from the bottom end 24 of shaft 12 up into the wedge section 20 a predetermined distance. As indicated previously, it is envisioned that rackets according to this invention can be made from any of the currently available materials or combinations of such materials including, but not limited to, wood, laminated wood, steel, aluminum, fiberglass, boron, graphite or molded plastic or polymer materials including polypropylene.

The lower wedge shaped portion 20 includes front and rear surfaces 26 and 28, respectively, and side surfaces 30 and 32, shown in FIG. *2b.* Side surfaces 30 and 32 are preferably perpendicular to the plane established by the racket head while the vertical dimension of surfaces 26 and 28 extending between surfaces 30 and 32 are substantially parallel with the racket head.

With continuing reference to FIGS. 1 and *2a,* grip assembly 14 is comprised of an internal core portion 40 over which a conventional external grip is applied as indicated at 42. The internal core 40 is provided with a hollow interior 44 and an enlarged well portion 46 adjacent the bottom end of the grip assembly.

As shown in FIG. 1, the main frame shaft 12 includes a shoulder 50 at the point where indented surfaces 26 and 28 begin with those surfaces extending downwardly to the bottom end 24 at a particular angle. Thus, the wedge shape is defined by the slope of the front and rear surfaces 26 and 28. The hollow core portion 40 of the grip assembly 14 has an internal shape that corresponds substantially to the wedge shaped area of the lower portion 20 of the main frame but larger so that an engineered space is formed therebetween. As shown in FIG. *2a,* once the main frame 12 is installed in the grip assembly 14, the bottom end 24 will occupy a position even with the innermost portion of well 46.

It should be noted that where the frame member is formed from a tubular structure, there will be two depending portions of that tubular frame and the wedge shape 20 for each of the two depending portions of that tubular frame would be shaped in the form of a cone. Thus, the grip would contain two cavities, one for each of those cones, and similarly two damping pads 16 and perhaps two tension subassemblies, one for each side of the tubular frame.

Core portion 40 of the grip assembly can be formed from a variety of materials including, but not limited to, rolled steel, aluminum or aluminum based alloys, graphite fibers, fiberglass or other related resins or reinforced polymer moldings including, but not limited to, polypropylene.

Grip cover 42 on core 40 can be either leather strips, fabric or some other convenient covering material including synthetics or a combination of synthetic and natural products.

While the wedge shaped portion 20 of shaft 12 has a shape substantially similar to the shape of the interior core 40 of grip assembly 14, it will not be entirely the same and an engineered gap or space will be designed therebetween. This engineered space or gap is the area in which damping pad 16 will be placed, as shown in FIG. *2a.* The damping pad 16 can be formed from a variety of materials including natural or synthetic rubber compounds, polymer compounds or combinations.

It is the damping pad, as will be explained fully hereafter, that has a fundamental effect upon the performance of the racket and in achieving the goals set forth above with respect to providing a compromise between a rigid hitting platform and a very flexible racket that will minimize elbow damaging shocks from being transferred to the player's arm. In achieving that objective, there are four features which are of importance with respect to this damping pad 16. Those four features comprise (1) the type of material being used, (2) the design shape of the pad relative to the reacting parts (in this case, the lower wedge portion 20 and the interior of core 40), (3) the area of contact along which the lower portion 20 and the grip assembly 14 react, and (4) the location and reaction about a point approximately at the center of the grip assembly, which reaction occurs at maximum impact.

Figures 2A, 2B, 2C, 3A, 3B, 4A, 4B, 4C:
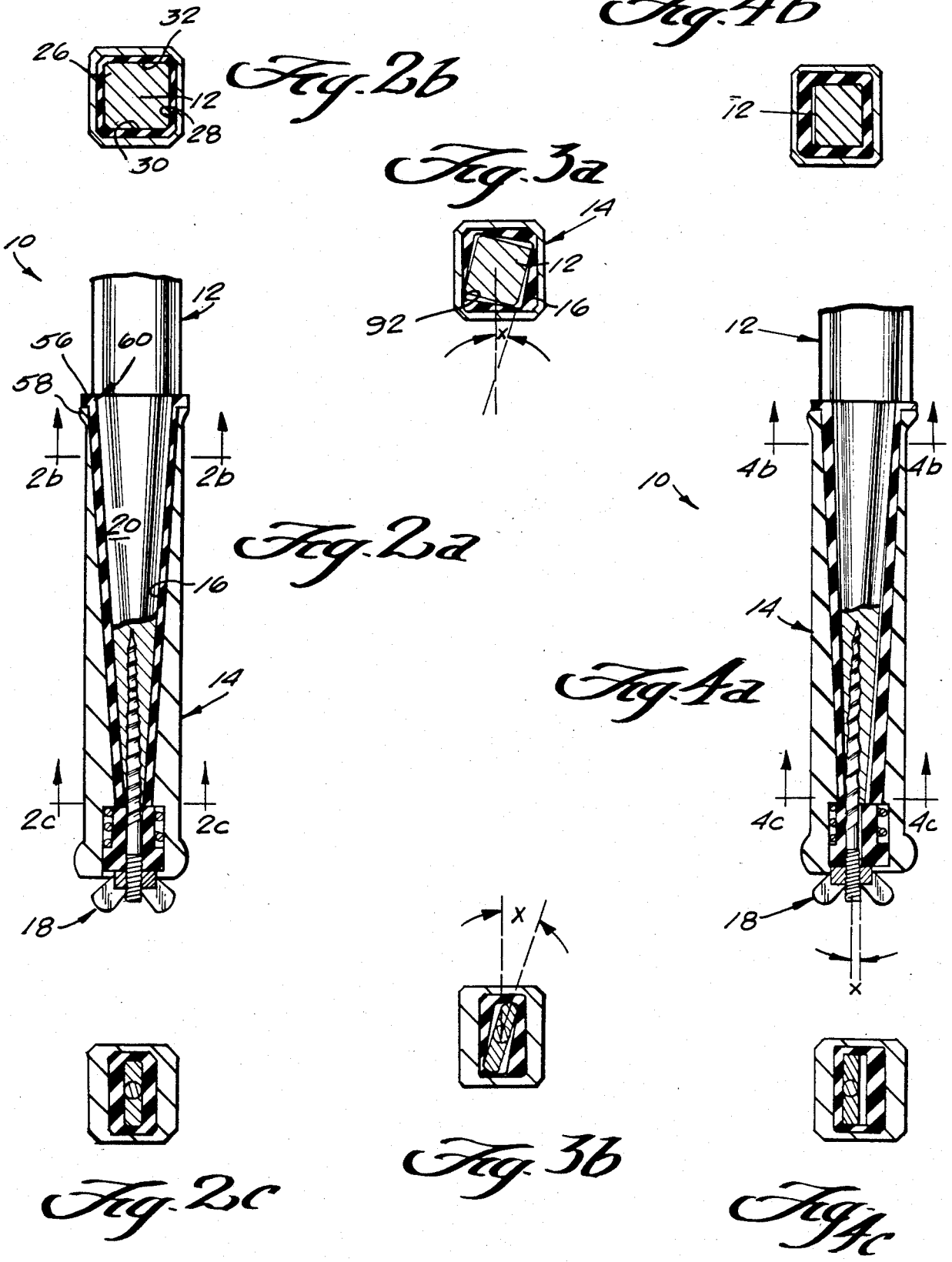

As indicated above, there is an engineered space between the grip assembly, specifically the core portion 40 which has a rigid construction to dissipate the residue of the damped shock vibrations throughout the whole grip area, and the wedge shape portion 20 of the frame 12. Damp pad 16 is molded or shaped so as to exactly fill this engineered space. By so designing the damping pad, damping pad 16 becomes progressively greater in thickness towards the bottom of the cavity formed between the shaft and the grip assembly to a point terminating at shoulder 52 from which wall 54 depends, with shoulder 52 and wall 54 together defining well 46. Because of the progressively greater pad thickness at the base portion of the main frame shaft 12, there will be provided additional impact adsorption capabilities and control allowing freer movement of the base of that shaft. Damp pad 16 is provided with a collar 56 adjacent the upper end that protrudes not less than about 1.0 mm beyond the top portion 58 of the grip assembly 14. This is best shown in FIG. 2*a*. This portion of damping pad 16 which protrudes beyond the upper portion 58, facilitates both the ample contact or damping area between the top edge or rim 58 of the grip and the recessed main frame handle 12 would also prevent one's fingers from being pinched by the movement of the racket during play and specifically at the point of impact.

In addition, damping material 16 insulates the main frame shaft 12 from the rigid grip 14 by not less than about 2.0 mm at the interior of the rim of the grip cavity so that damping of twisting action of a mishit ball can be achieved. This area is shown in FIG. 2*a* at 60.

In order to produce a "floating" effect grip and to insulate the shocks and jolts occasioned by stroking the ball and to make tension adjustments, the tension assembly 18 is provided at the base of grip assembly 14. Tension assembly 18 includes a threaded rod 70 which is securely screwed into bore 22, a small damping pad 72, spring 74, a washer 76 and an adjusting nut 78. Adjusting nut 78 is threadedly attached onto screw threads 80 provided at the base of rod 70.

Damping pad 72 includes a top end 82, a shoulder 84, with shoulder 84 being recessed inwardly in order to define a vertical wall 86. In addition, damping pad 72 includes a collar portion 88 and a bottom end surface 90. The dimensions of surface 82 are approximately equal to the dimensions of the base of damp pad 16, as shown in FIG. 2*a*, with spring 74 being retained in well 46 between shoulders 52 and 84. Thus, as the tensioning nut 86 is tightened, shaft 12 and grip assembly 14 will be brought into closer engagement as shown in FIG. 2*a* and pad 16 becomes more compressed.

FIGS. 2*a*, *b* and *c* show the racket handle in a static condition, wherein shaft 12 is centered both at the top and bottom of the grip assembly 14 as indicated by views 2*b* and 2*c*, respectively taken at lines 2*b*—2*b* and 2*c*—2*c*.

In FIGS. 3*a* and 3*b*, a ball has been struck by the racket off center with shaft 12 being rotated within grip assembly 14 about the vertical axes of the shaft/handle structure. This rotation will occur until corners 92 of shaft 12 engage the interior surfaces of the hollow interior 44 of grip assembly 14, as shown in FIG. 3*a* and this rotation will occur through an angle X. At this point, rotation due to a mishit or outer rim shot, will be absorbed but rotation will stop once the damping material 16 is compressed as shown and corners 92 have engaged grip assembly 14. Likewise, at the base of the tapered shaft 20, rotation through an engineered angle X will have also occurred. Rotation of the shaft relative to the grip assembly has, of course, occurred against the effects of damping material 16 so that shocks and vibrations of the off center hit will be adsorbed all along and between the shaft and handle surfaces in contact with the compressed damping material. Depending upon the tension applied by nut 78 with respect to the tensioning assembly 18, greater or lesser amounts of rotation and absorption will occur so that an individual can tailor the "feel" of the racket to their particular type of play.

In FIGS. 4*a*—4*c*, the reaction of the shaft 12 versus the grip assembly 14 is again shown at both the upper and lower portions of that grip assembly but the shot in this instance has been struck at its maximum impact point approximately at the center of the racket head. Damping material 16 will be impacted the greatest amount at a point adjacent the top and bottom of the tapered portion 20, as shown in FIG. 4*a* while the rotational moment about a horizontal axis of the grip assembly will occur at a point approximately at the center of the grip and approximately at the point where bore 22 terminates. Both the primary damping pad 16 and the small damping pad 72 will serve to absorb shock with the amount again depending upon the degree of tension applied by tensioning assembly 18. As indicated in FIGS. 4*a*–4*c*, there is no rotational moment about the vertical axis of the shaft when the ball was struck at the center of the racket head with the bottom portion of the tapered or wedge shaped lower portion 20 moving in a direction opposite to the portion of shaft 12 adjacent the top of grip assembly 14.

Use of a rigid grip assembly 14, transmits the shock vibrations throughout the total grip area and avoids unusual or undesirable feel characteristics by spreading those shock vibrations along that entire area. This tends to produce a floating grip effect. Because of the extent of the contact or of the type of damping material being used, there is fairly wide range of adjustments in order to achieve the desired amount of damping or shock vibration absorption as is desired. For example, the dimensions of this handle assembly are approximately as follows Representative Dimensions of Various Portions

| | | |
|---|---|---|
| 1. Height of wall 54 | = | 20 mm |
| 2. Length of bore 44 | = | 150 mm |
| 3. Length of damp pad 16 | = | 152 mm |
| 4. Length of walls 26 & 28 | = | 152 mm |
| 5. Thickness of shaft at 50 | = | 18 mm |
| Thickness of shaft at 24 | = | 5 mm |
| Width of shaft at 50 & 24 | = | 25 mm |
| 6. Length of bore 22 | = | 60 mm |
| 7. Steel spring with 30 lb to 50 lb compression (thus determines the amount of force that can be applied by the tension assembly). | | |

Actual Shock Absorbed

There are two measurable directions of shock when a ball is struck by the racket.

(a) The linear shock, as when the ball is struck along the central axis of the racket.

(b) The rotational shock as when the ball is miss-hit on the "wood" or side of the racket face.

The amount of shock absorbed is dependent on the type of material used and the tension setting, but tests done with rackets using the same hitting platform indicate the following:

| Tension Settings | Linear Shock Absorbed | Rotational Shock absorbed |
|---|---|---|
| High | 4% | 7% |
| Low | 17% | 29% |

The compounded effect of the two directional shock absorbtion is therefore substantial.

With reference now to FIGS. 5, 6 and 7, an additional embodiment is shown in which the main frame shaft 12 has a modified lower wedge portion 20' which also depends downwardly from shoulder 50. The modified lower wedge portion 20' is formed to include a fork, generally indicated at 100, comprised of legs 102 and 104 defining a space or gap 106 therebetween. Damping pad 16 and grip assembly 14 remain the same as in the embodiment shown in FIG. 1. Tensioning assembly 18' is modified by changing the tensioning mechanism to employ a hook member 108 provided with a threaded lower portion 110 for engagement with a tightening nut 112. For cooperating with hook 108, and specifically the upper hook portion 114, a swivel bar 116 is provided between legs 102 and 104, adjacent the innermost part of space 106. As shown in FIGS. 5 and 6, the hook portion 114 of hook 108 will fit over swivel bar 116 so that tensioning nut 112 can apply appropriate tension within grip assembly 14. As will be seen from comparing FIGS. 5 and 7 with FIG. 6, while the damping pad 16 is wedged shaped and becomes progressively thicker from the upper end of the grip assembly 58 down toward shoulder 52, thus, filling the engineered space between the wedge shaped main frame lower portion 20' and the hollow interior 44 of core member 40 of the grip assembly 14 in FIG. 6, the side walls of the core 40 remain substantially uniform in thickness from the upper portion 50 down to shoulder 52 and damping pad 16 similarly has a uniform thickness along that same area so as to again fill the engineered space between the shaft and grip portions.

Tension adjustment in this embodiment is achieved by tightening or loosening nut 112 on the threads 110 of hook 108 which will appropriately take up or release tension in the hook 108. Because the extent of the contact area between the principle parts of the handle assembly are angled in the direction of movement caused through the alteration on tension on the rod or hook 108, an increase or decrease, accordingly, of pressure along the total surface area between such parts will cause a change in pressure within the damping material.

Because of the relatively uniform thickness and thinness of the damping material between the lower portion of shaft 12 and handle assembly 14, little movement from side to side is possible. Thus, movement will generally be perpendicular to faces 26' and 28' as indicated in FIG. 7. In this instance, maximum impact has generated movement corresponding to an engineered angle X, as indicated, with the lower portion of shaft 12 and specifically the lower portion of forks 102 and 104 moving against damping material 16 as permitted by the extension of assembly 18'. Similarly, at the upper portion of the assembly 14, damping pad 16 is also depressed.

The hook and swivel connection is set approximately at the mid point of the racket handle area and the use of this loose fitting arrangement prohibits the transmission of shock down the rod formed by the hook 108 and thus has a lesser tendency to loosen the adjusting and tensioning means 18'.

It should be noticed that the swivel bar 116 has a slight "V" shape at its center portion thereby providing a self-centering feature for the hook 114. The fit between the hook and the swivel bar must provide sufficient play or movement to allow the main frame shaft 12 and the connected swivel bar 116 to rotate to the desired engineered angle when either a mishit occurs, such as adjacent the outer periphery of the racket or when maximum impact is achieved by a proper center hit on the racket head.

With respect to the fork extension 100 of shaft 12, it is important that the legs 102 and 104 extend as deeply as possible into the grip assembly 14 so as to insure the maximum advantage from the dynamic movement within the floating grip design and to permit the most absorption possible by damping material 16.

The above designs provide a structure and method for an adjustable handle arrangement for a racket which will provide that compromise between a rigid connection and a truly flexible or whippy connection to provide the proper feel when stroking balls and impact absorption to minimize the effects of vibrations and shocks on a user's body. The structure set forth and described above in each of the embodiments provides a simple way of holding together a plurality of different moving parts each with its own particular functions and movement characteristics. The handle arrangement provides a way to provide an adjustable amount of tension in a stable way and a structure that is durable and capable of neutralizing shock vibrations while at the same time providing the desired feel and touch characteristics that players demand of such rackets.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What I claim is:

1. A racket having a head and an adjustably dampened racket handle assembly for allowing the shocks induced from striking a ball with the head to be minimized while simultaneously controlling the hitting characteristics of the racket, said assembly including a main frame shaft depending from the racket head and means for controlling hitting characteristics of the racket and adjustably dampening shocks induced by striking a ball, said shaft having a longitudinal axis and a shaped lower portion, said controlling and dampening means including separate grip means removably attached to said shaft for providing a suitable hand grip for the racket, said grip means including a hollow interior shaped to be substantially complementary to the shaped lower portion of said main frame shaft and for receiving the shaped lower portion therein, tensioning means for adjustably securing said grip means and main frame shaft together, said tensioning means being movable relative to said grip means, and damping means for absorbing linear and rotational shocks positioned between and substantially along the mating surfaces of said grip means and main frame shaft so that when tensioned by said tensioning means and with said damping means under compression, said main frame shaft remains movable within and relative to said grip means horizontally toward or away from and rotationally about the longitudinal axis of the shaft.

2. A racket handle assembly as in claim 1, wherein the grip means has top exterior edge and said shaped lower portion has a bottom end and wherein the quantity of damping means becomes progressively thicker from a smaller portion located adjacent the juncture between said top exterior edge and said shaped lower portion to a larger portion adjacent the bottom end of said shaped lower portion.

3. A racket handle assembly as in claim 1 wherein the cross-section of said shaped lower portion is substantially square.

4. A racket handle assembly as in claim 1 wherein said shaped lower portion has front, rear and side surface with the front and rear surfaces being tapered along their length.

5. A racket handle assembly as in claim 4 wherein said shaped lower surface and said grip means are designed to allow relative motion about a vertical central axis of said grip means and a horizontal axis located at about the midpoint of said grip means and being parallel with the plane established by the racket head.

6. A racket handle assembly as in claim 1 wherein said damping means is comprised of natural materials.

7. A racket handle assembly as in claim 1 wherein said damping means is comprised of synthetic materials.

8. A racket handle assembly as in claim 1 wherein said tensioning means includes a separate damping member, spring means for providing the established tension and means for providing a compressive connection between said shaped lower portion and said grip means.

9. A racket handle assembly as in claim 8, wherein said compressive connection means includes rod means secured to said shaped lower portion for providing a tension adjusting extension, said rod means having a threaded exterior end portion extending outwardly from said shaped lower portion, and nut means for engaging said threaded exterior end portion.

10. A racket handle assembly as in claim 9 whrein said rod means is threadedly engaged with said shaped lower portion.

11. A racket handle assembly as in claim 9 wherein said shaped lower portion includes means defining a slot extending upwardly a predetermined distance from the bottom thereof and said rod means being pivotally connected to said main frame shaft within said slot means.

* * * * *